United States Patent [19]

Yamada et al.

[11] 4,186,792

[45] Feb. 5, 1980

[54] APPARATUS FOR MONITORING AND CONTROLLING THE LEVEL OF THE MOLTEN METAL IN THE MOLD OF A CONTINUOUS CASTING MACHINE

[75] Inventors: Takeo Yamada; Seigo Ando; Yoshio Miyashita; Katsuhiko Murakami; Masahisa Tate; Kiyoshi Mizui, all of Yokohama, Japan

[73] Assignee: Nippon Kokan Kabushiki Kaisha, Tokyo, Japan

[21] Appl. No.: 862,501

[22] Filed: Dec. 20, 1977

[30] Foreign Application Priority Data

Dec. 21, 1976 [JP] Japan ..... 51-152839

[51] Int. Cl.[2] ..... B22D 11/16

[52] U.S. Cl. ..... 164/150; 164/449; 164/413

[58] Field of Search ..... 164/150, 413, 449; 324/207

[56] References Cited

U.S. PATENT DOCUMENTS

| | | | |
|---|---|---|---|
| 3,300,820 | 1/1967 | Tiskus et al. | 164/449 |
| 3,997,835 | 12/1976 | Ando et al. | 324/207 |
| 4,030,027 | 6/1977 | Yamada et al. | 324/207 |

OTHER PUBLICATIONS

"Handbook for Continuous Casting of Metal", Herrmann, p. 343, FIG. 1176.

*Primary Examiner*—Robert D. Baldwin
*Attorney, Agent, or Firm*—Fleit & Jacobson

[57] ABSTRACT

There is disclosed a molten metal level monitoring and controlling apparatus for continuous casting machines which employs an eddy-current type distance measuring device for measuring the level of the molten metal in the mold of a continuous casting machine. The eddy-current type distance measuring device generates a molten metal level signal by detecting in a noncontact manner the distance between its detecting mechanism fixedly mounted in place just above the surface of the molten metal and the molten metal level. According to another embodiment of the invention, the detecting mechanism of the eddy-current type distance measuring device is arranged so as to be vertically movable just above the surface of the molten metal, whereby the detecting mechanism is moved in response to variations in the level of the molten metal to always maintain constant the distance of the detecting mechanism from the molten metal level, and the potentiometer attached to the detecting mechanism generates a molten metal level signal indicative of the distance travelled by the detecting mechanism. The thusly generated molten metal level signal is displayed on a recorder and it is also used for adjusting the pouring rate and the casting withdrawing rate through a monitoring and controlling mechanism so as to maintain the level of the molten metal in the mold within a predetermined range.

1 Claim, 8 Drawing Figures

APPARATUS FOR MONITORING AND CONTROLLING THE LEVEL OF THE MOLTEN METAL IN THE MOLD OF A CONTINUOUS CASTING MACHINE

BACKGROUND OF THE INVENTION

The present invention relates to molten metal level monitoring and controlling apparatus for continuous casting machines, and more particularly the invention relates to such molten metal level monitoring and controlling apparatus of the type employing an eddy-current type distance measuring device for molten metal level measuring purposes so as to control the level of the molten metal at a predetermined height in the mold.

In the past, measuring means utilizing radiation or thermocouples have been put in practical use for the purpose of molten metal level detection which is necessary for controlling constant the level of the molten metal in the mold of a continuous casting machine.

The measuring means of the type utilizing radition is designed so that as shown by the plane view and the sectional view along the line a—a' of FIG. 1, a radiation source 12 and a scintillator 13 are embedded in the side walls of a mold 10 at the metal level positions so as to detect a molten level 11 on the basis of a change in the amount of the transmitted radiation due to the molten metal, and the detecting means of this type is disadvantageous from safety and sanitation points of view in that the operator must work in the vicinity of the radioactive material.

On the other hand, the measuring means of the type employing thermocouples is so designed that as shown by the plane view and the sectional view along the line b—b' of FIG. 2, a plurality of thermocouples 14 are embedded in the inner surface of the opposing side walls of a mold 10 so as to detect the temperature difference between the position where the mold 10 is not contacting the molten metal and another position where it is in contact with the molten metal and thereby to detect the level of the molten metal, and this type of detecting means is disadvantageous in that the response speed for temperature detection is not high enough and that the response speed is variable depending on the material or thickness of the mold itself.

Moreover, due to the fact that all of these measuring means must incorporate the measuring device inside the mold, they are disadvantageous in that the essential function of the mold itself is deteriorated, that the required maintenance and servicing cannot be effected satisfactorily, and that the measuring accuracy will be limited to about ±15 mm. Thus, the problem with the prior art measuring apparatus is that even if the conventional measurement of the molten metal level is effected to maintain the molten metal level constant, the resulting control accuracy and response speed cannot be satisfactory and it is impossible to ensure perfect control of molten metal level, thus deteriorating the surface properties of the cast sections and also tending to cause mold slag inclusion.

SUMMARY OF THE INVENTION

The present invention has been created with a view to overcoming the deficiencies of the molten metal level monitoring and controlling apparatus for continuous casting machines due to the conventional method of measuring the level of molten metal, and it is an object of the present invention to provide a molten metal level monitoring and controlling apparatus for a continuous casting machine in which an eddy-current type distance measuring device comprising a feedback amplifier circuit is used for molten metal level measuring purposes, whereby the measured molten metal level is displayed and recorded and at the same time the level of the molten metal is controlled at a constant height in the mold.

It is another object of the invention to provide such molten metal level monitoring and controlling apparatus which is capable of measuring the level of the molten metal in the mold by means of an eddy-current type distance measuring device without contact with the molten metal surface and without being affected by the slag present on the surface of the molten metal.

It is still another object of the invention to provide such molten metal level monitoring and controlling apparatus which is capable of maintaining the level of the molten metal in the mold within a predetermined range by means of the measured molten metal level.

It is still another object of the invention to provide such molten metal level monitoring and controlling apparatus in which the pouring rate of molten metal into the mold and the rate of withdrawal of the casting from the mold are adjusted in accordance with the measured molten metal level.

It is still another object of the invention to provide such molten metal level monitoring and controlling apparatus in which the eddy-current type distance measuring device consists of a feedback amplifier circuit, thereby making it possible to measure the level of the molten metal in the mold with a high degree of accuracy and high response speed.

The above and other objects, features and advantages of the present invention will become more apparent from considering the following detailed description.

DESCRIPTION OF THE PREFERRED EMBODIMENTS

Figure 1:
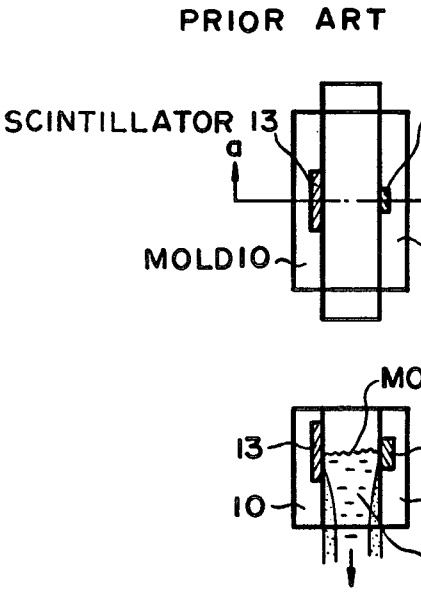
FIG. 1 shows a plane view and sectional view for explaining a prior art method of detecting the level of molten metal by means of radiation.
Figure 2:
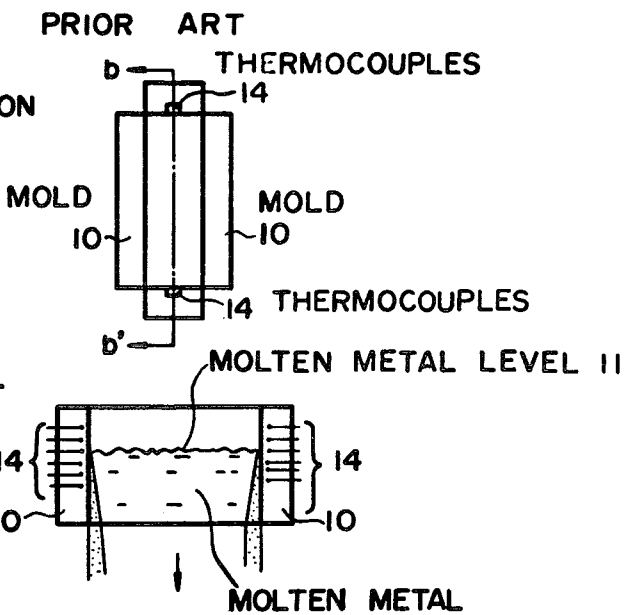
FIG. 2 shows a plane view and sectional view for explaining another prior art method of detecting the level of molten metal by means of thermocouples.
Figure 3:
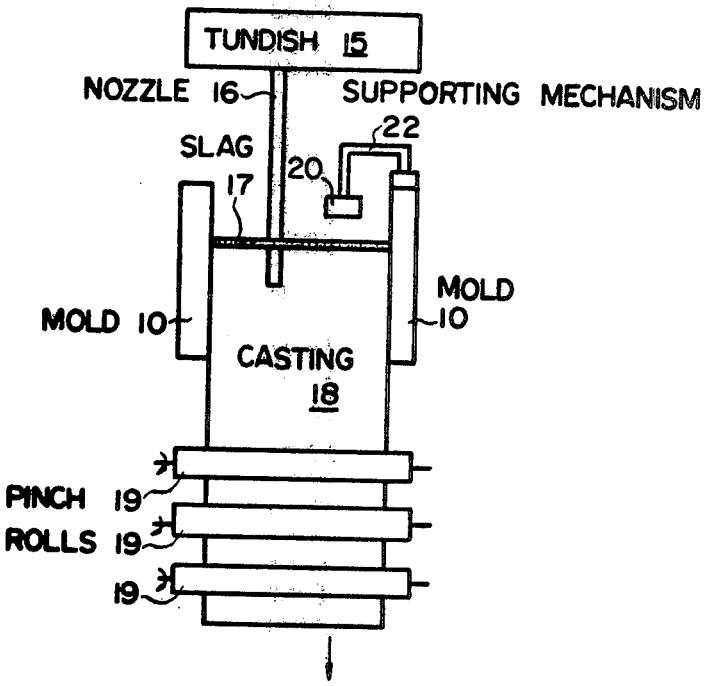
FIG. 3 is a schematic diagram showing the surrounding of the tundish of a continuous casting machine on which is fixedly mounted the detecting means of an eddy-current type distance measuring device used with the present invention.

Referring now to FIG. 3 showing schematically the tundish of a continuous casting machine and the associated parts, numeral 15 designates a tundish, 16 a nozzle through which molten metal is poured into a mold 10 from the tundish 15, 17 a layer of the slag on the surface of the molten metal, 18 a casting which is being withdrawn continuously, and 19 pinch rolls for withdrawing the casting 18. Detecting means 20 of an eddy-current type distance measuring device used with the invention for molten metal level measuring purposes, is disposed by a suitable supporting mechanism 22 just above the surface of the molten metal in the mold at a predetermined distance therefrom.

The circuit construction of the eddy-current type distance measuring device will be described with reference to FIG. 4. This eddy-current type distance measuring device is of the same type as disclosed in U.S. Pat. No. 4,030,027 granted to the applicant.

Figure 4:
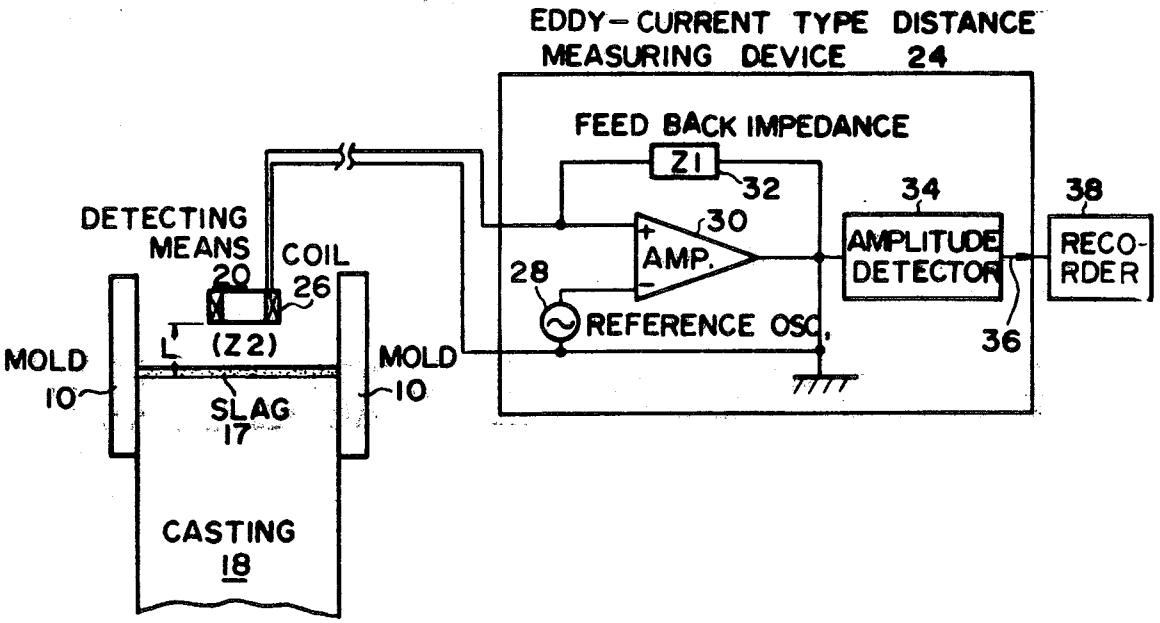
FIG. 4 is a circuit diagram of the eddy-current type distance measuring device used with the invention.

More specifically, in FIG. 4 an eddy-current type distance measuring device 24 comprises a feedback amplifier circuit including a detecting coil 26 incorporated in the detecting means 20 disposed just above the surface of the molten metal, an AC constant-voltage reference oscillator 28 for providing an AC voltage, a differential amplification type amplifier 30, a feedback impedance 32 constituting a positive feedback circuit and an amplitude detection circuit 34, and the distance signal or molten metal level signal 36 generated by the eddy-current type distance measuring device 24 is applied to a suitable recorder 38 where the signal is displayed and recorded.

The detecting coil 26 in the detecting means 20 is fixedly disposed at a desired distance L from the surface of the molten metal in the mold 10, so that when the impedance $Z_2$ of the detecting coil 26 is varied in response to a fluctuation in the level of the molten steel, the output voltage $V_o$ of the amplifier 30 becomes as follows $$\frac{V_o}{E} = \frac{-G}{1 - G \cdot \frac{Z_2}{Z_1 + Z_2}}$$

Where G is the amplifier gain, E is the reference voltage of the AC constant-voltage reference oscillator 28, and $Z_1$ is the impedance of the feedback impedance 32. In other words, since all of these values are constants excepting the impedance $Z_2$ of the detecting coil 26, it is possible to obtain an output $V_o$ corresponding to a variation in the impedance $Z_2$ of the detecting coil 26.

Figure 5:
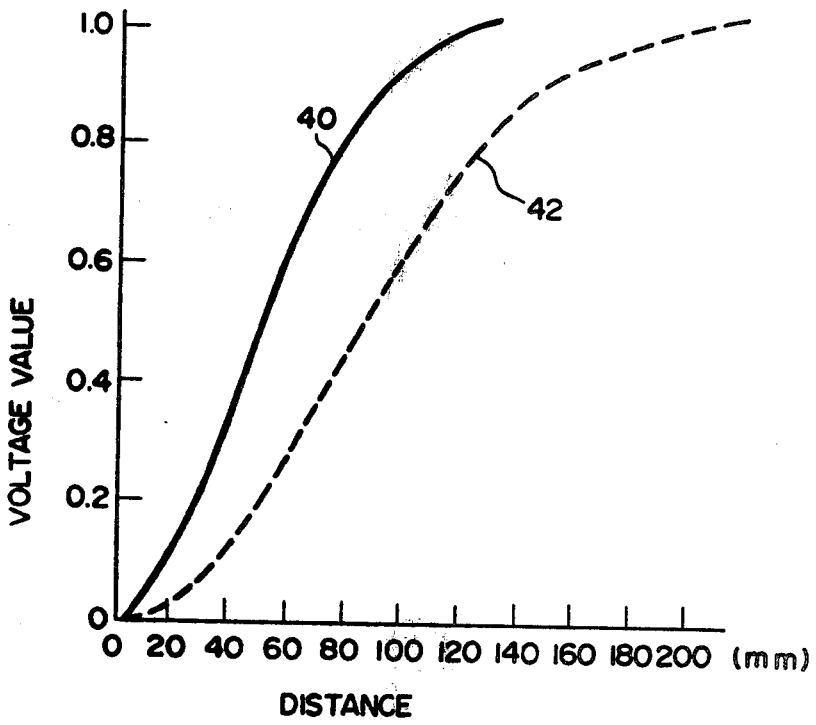
FIG. 5 is a graph showing a molten metal level measuring characteristic of the eddy-current type distance measuring device.

The graph of FIG. 5 shows the measurement results obtained by using the eddy-current type distance measuring device of the feedback amplifier circuit type shown in FIG. 4. In the Figure, the abscissa represents the distance of the detecting coil from the surface of the molten metal and the ordinate represents the voltage value resulting from the detection of the amplifier output by the amplitude detection circuit. The AC reference voltage E was selected about 50 KHz.

In FIG. 5, the curve 40 represents the characteristic of a detecting coil having a diameter of 60 mm and the measuring range was from about 0 to 100 mm. The curve 42 represents the characteristic of a detecting coil having a diameter of 110 mm and the measuring range was from about 0 to 150 mm.

When used in the measurement of the molten metal level, the eddy-current type distance measuring device with such characteristics has the following features and advantages: The noncontact measurement of the molten metal level can be effected just above the surface of the molten metal; by virtue of the measurement utilizing the eddy current effect, any displacement of the molten metal level can be measured without being affected by the slag layer on the surface of the molten metal; improved response speed of the order of m sec, for example, can be ensured; greater measurement accuracy of the order of ±2 mm can be expected; and the construction of the detecting device can be simplified with the resulting reduction in the equipment cost. Thus, it is possible to obtain a result much superior to that of the prior art measurements utilizing radiation or thermocouples.

As a result, by utilizing the distance signal generated by the above-described eddy-current type distance measuring device so as to operate a monitoring and controlling apparatus that will be described later, it is possible to always maintain the level of the molten metal in the mold at a predetermined value.

Figure 6:
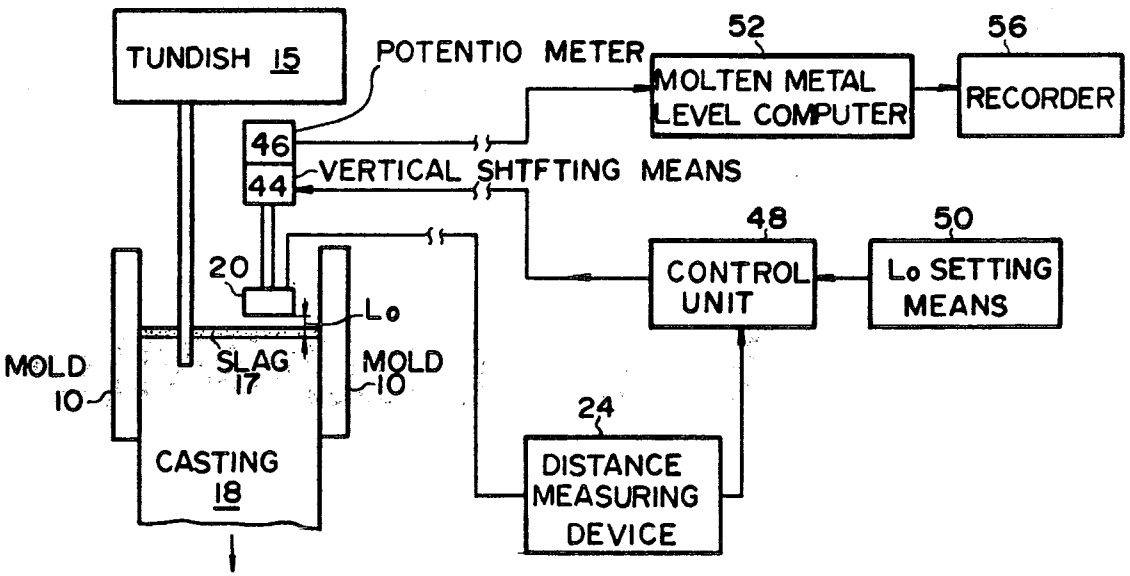
FIG. 6 is a schematic block diagram showing another embodiment of the invention in which the detecting means is movable in response to variations in the level of the molten metal in the mold.

While, in the embodiment shown in FIGS. 3 and 4, the detecting means of the eddy-current type distance measuring device is of the type fixedly mounted to the mold, the second embodiment of the invention shown in FIG. 6 is designed to measure the level of the molten metal in the mold by means of the detecting means adapted to be moved vertically in response to variations in the level of the molten metal so as to always maintain a predetermined distance therebetween. The second embodiment is suitable for ensuring an increased measuring range in applications where the mold width is so small that it is impossible to use a large detecting coil. For instance, where it is desired to ensure a measuring range of 0 to 150 mm but it is impossible to use the previously mentioned detecting coil of 110 mm, the measuring range can be easily increased as desired by using the detecting coil of 60 mm along with a follow-up type mechanism.

In FIG. 6, the supporting mechanism for positioning detecting means 20 just above the surface of the molten metal is provided with a vertical shifting mechanism 44 including a servomotor for vertically moving the detecting means 20, and the amount of movement of the vertical shifting mechanism 44 is detected as a signal output by a potentiometer 46 coupled thereto. The control means of the vertical shifting mechanism 44 comprises distance setting means 50 for establishing a predetermined distance $L_O$ between the detecting means 20 and the surface of the molten metal, and a control unit 48 adapted to receive the preset value $L_o$ of the setting means 50 as a reference input so as to control the servomotor of the vertical shifting mechanism 44 in accordance with the difference between the reference input and the measured distance signal applied from the distance measuring device 24 and thereby to maintain the preset distance $L_o$. The output of the potentiometer 46 is applied to a molten metal level computer 52 which in turn converts the amount of movement of the vertical shifting mechanism 44 to a molten metal level signal proportional thereto and the signal is applied as a distance signal 54 to a recorder 56.

With the construction described above, when the level of the molten metal changes, the control unit 48 controls the servomotor of the vertical shifting mechanism 44 so as to follow up or respond to the change and thereby to cause the output 36 of the distance measuring device 24 to agree with the preset value $L_o$ of the setting means 50. As a result, the distance of the detecting means 20 to the surface of the molten metal is always maintained at the predetermined value $L_o$. Since the servomotor of the vertical shifting mechanism 44 is coupled to the potentiometer 46, the potentiometer 46 generates an output indicative of the displacement of the detecting means 20 so that the output is processed in the molten metal level computer 52 and is recorded as a distance signal 54 indicative of the molten metal level in the recorder 56.

With this embodiment, the measuring range is dependent on the stroke of the servomotor in the vertical shifting mechanism 44, and consequently any large measuring range can be determined as desired and easily.

Further, while the output characteristic of the eddy-current type distance measuring device has substantially a linear form as shown in FIG. 5, the measurement by the distance measuring device is controlled so as to maintain a single point or preset value $L_o$ on the graph, and consequently the output characteristic is dependent on the potentiometer, thus further improving the linearity and increasing the accuracy of molten metal level control. Still further, by virtue of the follow-up mechanism which is movable in response to variations in the level of the molten metal, even if the level of the molten level rises greatly, the detecting means is automatically raised thus preventing burning loss of the component parts and thereby ensuring a high degree of utility as an industrial instrument.

Figure 7:
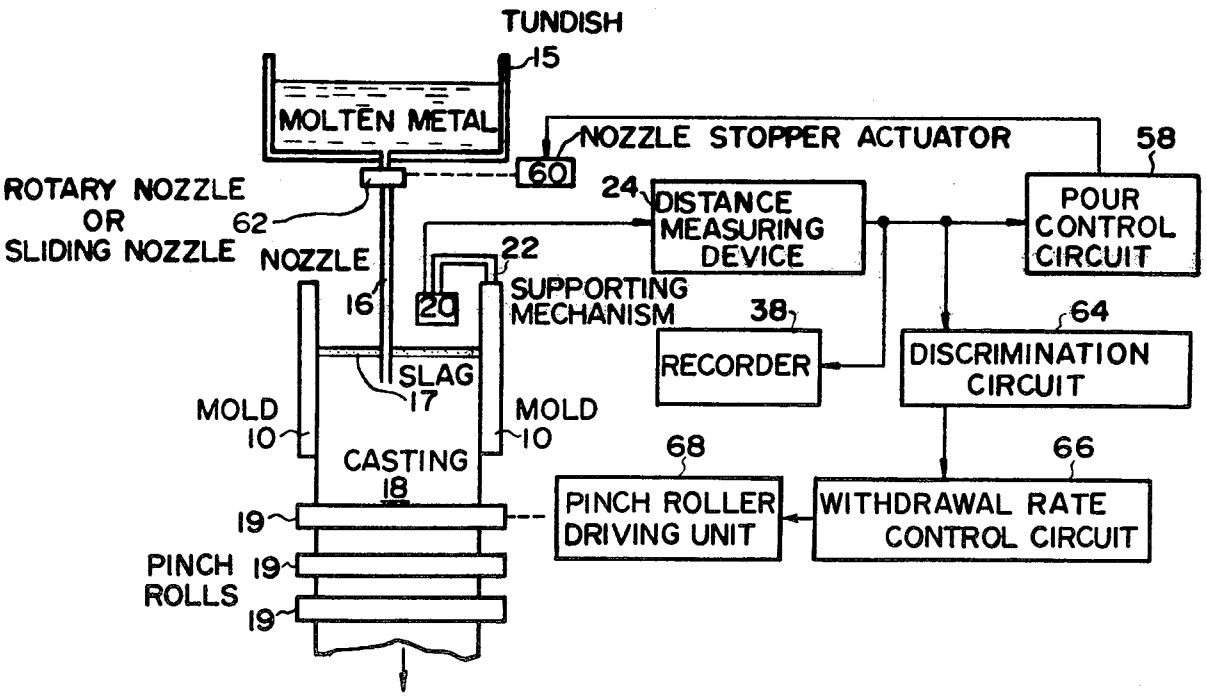
FIG. 7 is a schematic block diagram showing an exemplary molten metal level monitoring and controlling apparatus according to the invention in which molten metal level control is accomplished in response to the distance signal from an eddy-current type distance measuring device.
Figure 8:
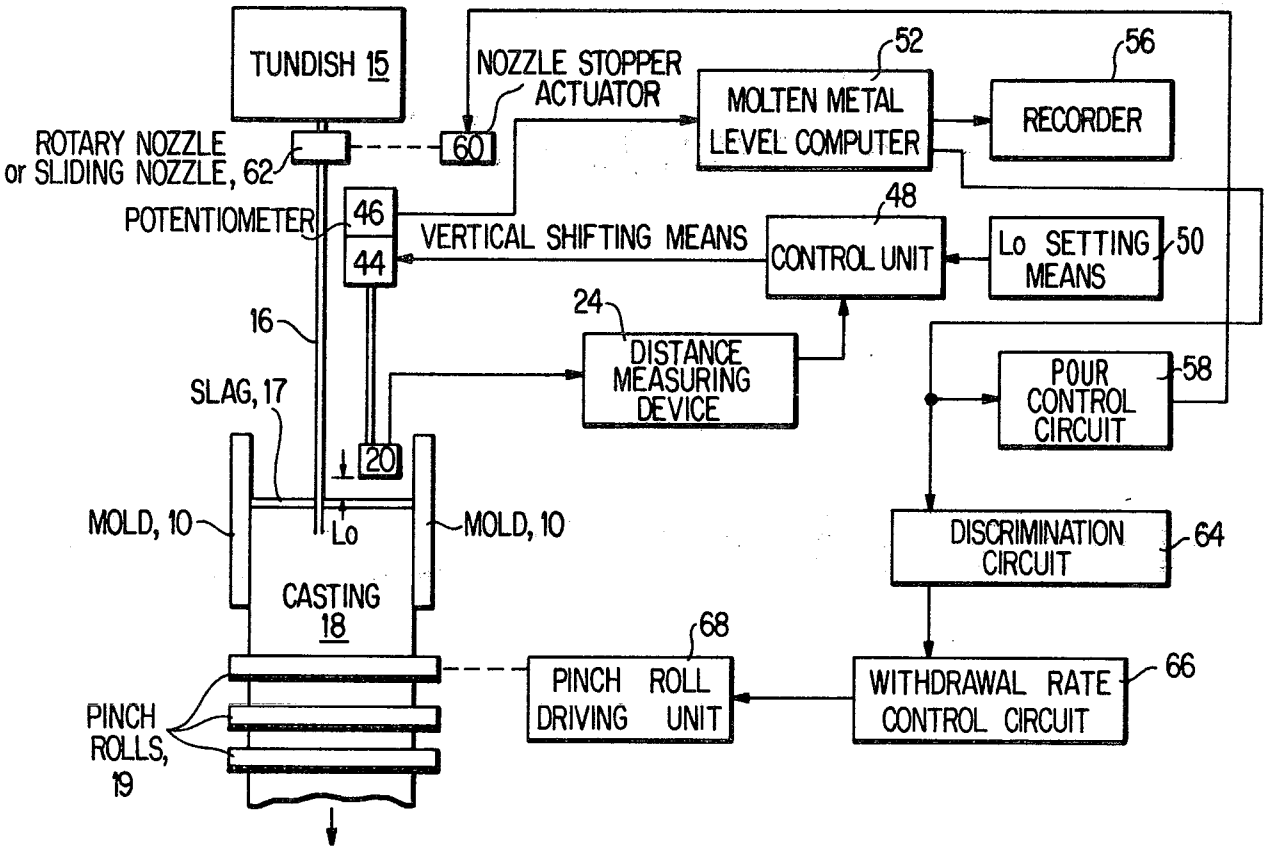
FIG. 8 is a schematic block diagram combining the embodiments illustrated in FIGS. 6 and 7.

FIG. 7 illustrates a molten metal level monitoring and controlling apparatus according to the invention, which is adapted to incorporate the molten metal level measuring devices shown in the embodiment of FIGS. 3 and 4 and the embodiment of FIG. 6. While, in the apparatus shown in FIG. 7, the detecting means 20 is fixedly mounted, it is of course possible to use a detecting means of the follow-up type as shown in FIG. 6. FIG. 8 illustrates such an embodiment of the present invention.

In the Figure, numeral 58 designates a pour control circuit, 60 a nozzle stopper actuator, 62 a rotary nozzle or sliding nozzle, 64 a molten metal level range discrimination circuit, 66 a withdrawal rate control circuit, and 68 a pinch roller driving unit. The concept of molten metal level control for this type of control apparatus is such that normally the amount of molten metal poured into the mold is controlled by means of the rotary nozzle or sliding nozzle, so that when the level of the molten metal rises or falls beyond the control range, the withdrawal rate of the pinch rollers is controlled correspondingly.

In other words, the distance signal 36 from the eddy-current type distance measuring device 24 is applied to the pour control circuit 58, and the degree of opening of the rotary nozzle 62 is adjusted through the actuator 60 so as to control the level of the molten metal at a preset value. If this pour control fails to function normally due to the clogging of the nozzle or any other trouble, the molten metal level will be caused to vary beyond the upper or lower limit value. Such abnormal condition is detected by the molten metal level discrimination circuit 64 so that the distance signal is applied to the withdrawal rate control circuit 66 and the operation of the pinch rolls 19 are controlled through the pinch roller driving unit 68, thus adjusting the withdrawal rate of the casting 18 and thereby holding the level of the molten metal at a proper value in the mold.

While the basic concept of control by the above-described molten metal level controlling apparatus is the same with that of the prior art apparatus, the molten metal level monitoring and controlling apparatus of this invention has, by virtue of the use of an eddy-current type distance measuring device, remarkable advantages over the prior art apparatus.

In other words, since the molten metal level distance measuring device has a very high response speed and its accuracy of measurement is as high as ±1 to 2 mm, the accuracy of control of the apparatus as a whole is dependent on the controllability of the rotary nozzle, with the result that in the normal condition the amount of variation in the level of molten metal can be held within about ±5 mm thus greatly improving the accuracy of control over the control accuracy of ±15 mm for the prior art radiation-type and thermocouple-type apparatus. In the event of a falling phenomenon of the molten metal level, by virtue of the high response characteristic, a control operation is effected immediately to reduce the withdrawal rate, with the result that not only the inclusion of the mold slag is prevented but also the range of the abnormal lowering of molten metal level is reduced and the frequency of such phenomenon is also decreased.

The stabilization of molten metal level accomplished by the present invention can, as a matter of consequence, result in a stable operation and contribute greatly toward improving the properties of product castings.

The measurement of molten metal level by the eddy-current type distance measuring device used with the invention is not intended to be limited to the measurement of the level of molten level in the mold, and it is usable in wide applications, such as, the measurement of molten metal level in the tundish, bottom pouring mold, molten iron ladle, etc.

We claim:

1. An apparatus for monitoring and controlling the level of a molten metal in a mold of a continuous casting machine, comprising:

supporting means for positioning detecting means of an eddy-current distance measuring device just above the surface of the molten metal in said mold, said detecting means detecting the surface;

monitoring and controlling means adapted to receive a distance signal generated from said distance measuring device in response to a variation in the level of said molten metal relative to said detecting means for controlling the level of the molten metal in said mold at a predetermined height and for simultaneously displaying said distance signal on a recorder, said supporting means comprising:

a shifting mechanism for vertically moving the detecting means of said eddy-current distance measuring device;

control means for actuating said shifting mechanism in such a manner that the distance signal applied from said distance measuring device is maintained at a predetermined value; and a potentiometer mounted to said shifting mechanism whereby a signal output corresponding to the amount of movement of said shifting mechanism is generated as a distance signal indicative of the level of the molten metal in said mold.

* * * * *